US007137586B2

(12) United States Patent
Talen

(10) Patent No.: US 7,137,586 B2
(45) Date of Patent: Nov. 21, 2006

(54) HYDRAULIC SPOOLER

(75) Inventor: Ronald Talen, Calgary (CA)

(73) Assignee: National-Oilwell, L.P., Houston, TX (US)

( * ) Notice: Subject to any disclaimer, the term of this patent is extended or adjusted under 35 U.S.C. 154(b) by 31 days.

(21) Appl. No.: 11/032,347

(22) Filed: Jan. 10, 2005

(65) Prior Publication Data

US 2006/0151653 A1 Jul. 13, 2006

(51) Int. Cl.
*B65H 54/28* (2006.01)

(52) U.S. Cl. ..... 242/481; 242/129.2; 242/483.9; 242/484.3; 254/335; 91/422

(58) Field of Classification Search ..... 242/476.7, 242/483.9, 129.2, 484.2, 481, 484.3, 478.2, 242/478.1, 484, 484.1; 91/438, 422; 92/112; 254/335, 326

See application file for complete search history.

(56) References Cited

U.S. PATENT DOCUMENTS

| | | | | |
|---|---|---|---|---|
| 1,728,915 | A | 9/1929 | Blankenship et al. | |
| 3,034,923 | A * | 5/1962 | Bowers | 427/178 |
| 3,536,298 | A | 10/1970 | Deslierres | |
| 4,211,376 | A | 7/1980 | Martin | |
| 4,421,284 | A | 12/1983 | Pan | |
| 4,588,142 | A | 5/1986 | Malzacher | |
| 4,767,073 | A | 8/1988 | Malzacher | |
| 4,778,121 | A | 10/1988 | Minnee | |
| 4,848,697 | A | 7/1989 | Skalleberg | |
| 5,009,353 | A | 4/1991 | Alquist | |
| 5,865,392 | A | 2/1999 | Blount et al. | |
| 5,944,099 | A | 8/1999 | Sas-Jaworsky | |
| 6,003,598 | A | 12/1999 | Andreychuk | |
| 6,082,454 | A | 7/2000 | Tubel | |
| 6,145,776 | A | 11/2000 | Kemppi | |
| 6,264,128 | B1 * | 7/2001 | Shampine et al. | 242/397.3 |
| 6,273,188 | B1 | 8/2001 | McCafferty et al. | |
| 6,357,688 | B1 | 3/2002 | Backlund et al. | |
| 6,443,431 | B1 | 9/2002 | Stasny et al. | |
| 6,530,432 | B1 | 3/2003 | Gipson | |
| 2003/0006034 | A1 | 1/2003 | Neal | |
| 2004/0021031 | A1 | 2/2004 | Klaus | |

* cited by examiner

*Primary Examiner*—Kathy Matecki
*Assistant Examiner*—William E. Dondero
(74) *Attorney, Agent, or Firm*—Conley Rose, P.C.

(57) ABSTRACT

Methods and apparatus for spooling a flexible member onto a drum with a spooler assembly. In certain embodiments, a spooler assembly comprises a spooler arm operable to guide a flexible member onto a drum rotating about a drum axis. A first actuator moves the spooler arm in a first direction that is parallel to the drum axis. The first actuator operates in a first mode wherein the flexible member is allowed to free movement in the first direction and a second mode wherein the first actuator controls the movement of the flexible member in the first direction. The spooler assembly may also comprise a second actuator that moves the spooler arm in a second direction that is perpendicular to the drum axis.

13 Claims, 5 Drawing Sheets

HYDRAULIC SPOOLER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

The present invention relates generally to methods and apparatus for spooling a linear flexible member. More particularly, the present invention relates to methods and apparatus for guiding a flexible member onto a rotating drum.

A spooler is a device used to guide a flexible member onto a drum and are used in many industries. Examples of flexible members include: cable, wireline, slickline, sandline, wire rope, and wire. Overhead spoolers comprise a swiveling arm mounted above a drum with a guide roller device or measuring head on the end to guide the flexible member onto the drum to ensure even and smooth wraps. The opposite end of the arm is attached to one or more swivel joints that allow the arm to be controlled in position both side to side and up and down. Many spoolers rely on hydraulic, or other power, to control the position of the arm.

In many spooling applications, it is desirable for the spooler to allow the material to "free spool" from side-to-side but provide power to guide the material onto the drum as needed. Many spooled materials have very little pulling power from side-to-side while wrapping onto the drum and too much drag from the spooler arm will not allow the material to self-spool. Thus, it is often necessary for the operator to constantly power the spooler arm in order to keep the spooler head properly positioned.

Because of this constant operation, auto-spoolers have been developed that move in synchronization with the drum to constantly move side-to-side as the drum rotates. When utilized in spooling multi-strand wireline cable, these auto-spoolers often do not operate properly. The multi-stranded cable has a tendency to change diameter as the cable is torqued and twisted. Although the diameter changes are minimal they can have a large effect on how the cable is spooled onto a drum. For example, consider a cable with a nominal outer diameter of 0.220 inches that sees a maximum diameter variation of 0.002 inches. If the cable is being wound on a 30 inch wide drum, the drum will hold 136 wraps per row at the nominal diameter, 135 wraps per row at the maximum diameter of 0.222 inches, and 137 wraps per row at the minimum diameter of 0.218 inches. Because each row of cable uses the previously spooled row as a guide, if the number of wraps per row is not consistent, the potential of damage to the cable exists.

Thus, there remains a need to develop methods and apparatus for spooling flexible materials onto a drum, which overcome some of the foregoing difficulties while providing more advantageous overall results.

SUMMARY OF THE PREFERRED EMBODIMENTS

The embodiments of the present invention are directed toward methods and apparatus for spooling a flexible member onto a drum with a spooler assembly. In certain embodiments, a spooler assembly comprises a spooler arm operable to guide a flexible member onto a drum rotating about a drum axis. A swing actuator moves the spooler arm in a swing direction that is parallel to the drum axis. The swing actuator operates in a first mode wherein the flexible member is allowed free movement in the swing direction and a second mode wherein the swing actuator controls the movement of the flexible member in the swing direction. The spooler assembly may also comprise a lift actuator that moves the spooler arm in a lift direction that is perpendicular to the drum axis.

In certain embodiments, a spooler assembly further comprises a pivot member connected to the lift actuator, which rotates the pivot member about a pivot axis that is parallel to the drum axis. The spooler arm may be moveably connected to the pivot member such that the swing actuator is operable to rotate the spooler arm about a swing axis that is perpendicular to the drum axis. The spooler assembly may also comprise a hydraulic source in fluid communication with the actuators and a control system operable to control the flow fluid from the hydraulic source to the actuators.

In some embodiments, the swing actuator comprises a translating sleeve connected to the spooler arm. A piston is disposed within the translating sleeve and forms first and second hydraulic chambers within the translating sleeve. A spool is disposed within the piston and has a first position that allows fluid communication between the first and second hydraulic chambers and a second position that restricts fluid communication between the first and second hydraulic chamber. A first hydraulic port is in fluid communication with the piston such that hydraulic pressure applied to the first hydraulic port moves the spool from the first position to the second position. When the spool is in the second position, the first hydraulic port is in fluid communication with the first hydraulic chamber.

A spooling method may comprise activating a spooler arm so as to control the side-to-side position of a flexible member winding onto a drum and deactivating the spooler arm so that the flexible member and the spooler arm can move freely from side-to-side. Activating the spooler arm further comprises supplying hydraulic pressure to a first port of a swing actuator, providing fluid communication between the first port and a spool disposed within a piston, wherein the piston is slidably disposed within a translating sleeve and forms a first and second hydraulic chamber within the translating sleeve, and shifting a spool so as to provide fluid communication between the first port and the first hydraulic chamber.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
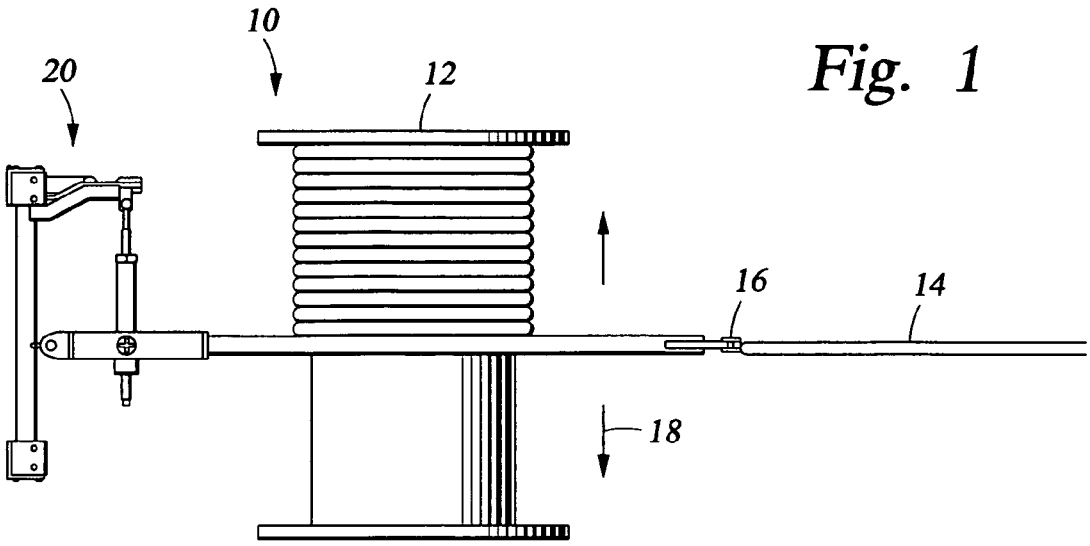
FIG. 1 is a drum and spooler assembly constructed in accordance with embodiments of the invention.

Referring now to FIG. 1, cable reeling assembly 10 comprises rotating drum 12 for storing a flexible member, herein referred to as cable 14. Cable 14 is guided onto drum 12 by spooler assembly 20. Spooler assembly 20 contacts cable 14 with spooler head 16. Spooler assembly 20 is operable to translate side-to side 18 as cable 14 wraps onto drum 12 and up-and-down as additional wraps of cable are added to the drum. In the preferred embodiments, spooler assembly 20 allows cable 14 to freely move side-to-side but is operable to provide control of how the cable wraps onto drum 12 as desired.

Figure 2:
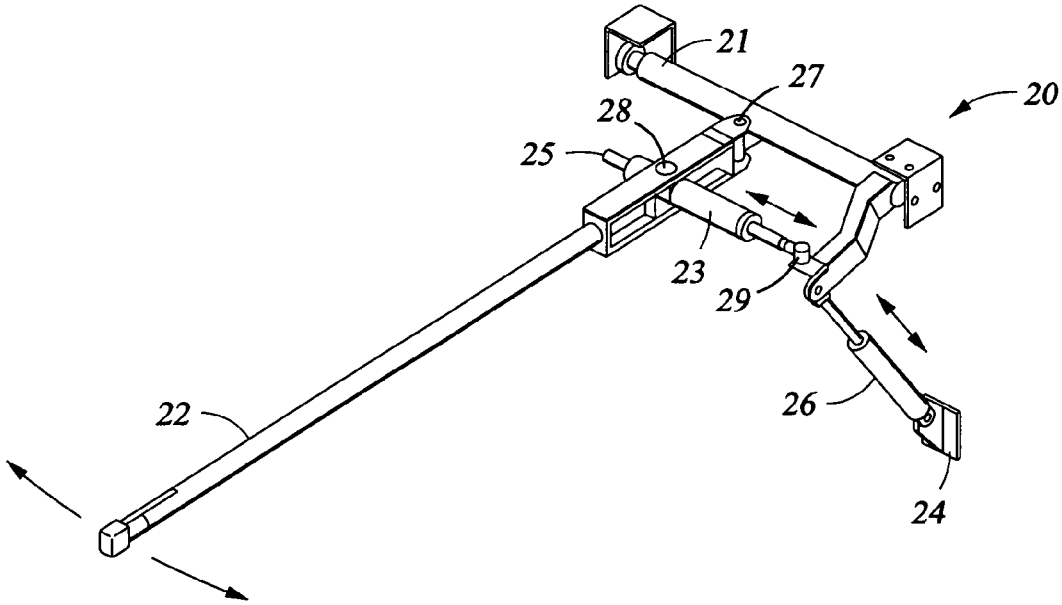
FIG. 2 is a spooler assembly constructed in accordance with embodiments of the invention.

Referring now to FIG. 2, spooler assembly 20 comprises pivot pipe 21, spooler arm 22, swing cylinder 23, and lift cylinder 26. Spooler arm 22 is pivotally mounted to pivot pipe 21 at pin 27. Swing cylinder 23 is a double action hydraulic cylinder having a fixed end 29, which is connected to pivot pipe 21, and a translating sleeve 25 that is connected to spooler arm 22. Lift cylinder 26 comprises a fixed end 24 and is connected to pivot pipe 21.

Spooler assembly 20 is operable to allow a cable, or other flexible member, to spool freely onto a drum but provide intervention to control the spooling when necessary. Assembly 20 provides both side-to-side and up-and-down control of the spooling of the cable. Up-and-down motion is controlled by lift cylinder 26 causing spooler arm 22 to rotate about the longitudinal axis of pivot pipe 21. Side-to-side motion is controlled by swing cylinder 23, which moves spooler arm 22 relative to pivot pipe 21 about pin 27.

Lift cylinder 26 is a double acting hydraulic cylinder. When hydraulic pressure is applied to lift cylinder 26 it extends and causes pivot pipe 21, and spooler arm 22, to rotate about its longitudinal axis. Lift cylinder 26 may include a relief valve to maintain the spooler arm 22 in line with the cable. The relief valve is set so that a torque balance is maintained on pivot pipe 21 between the force generated by lift cylinder 26 and the total force from the combination of spooler arm 22, measuring head 16, and cable 14. Lift cylinder 26 may be used in applications that require cable 26 to pass straight through measuring head 16

Figure 3:
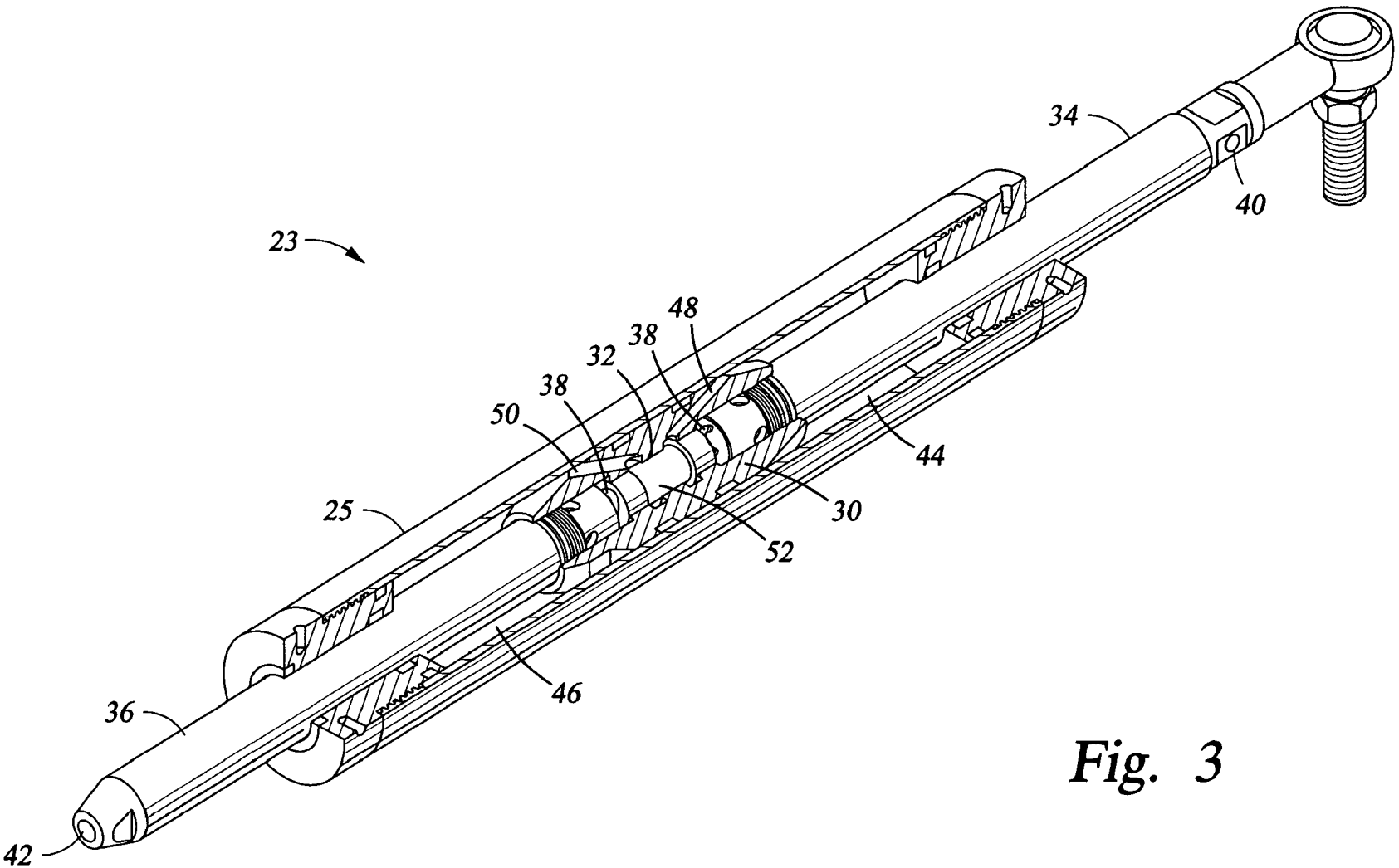
FIG. 3 is a partial cross sectional view of a swing cylinder constructed in accordance with embodiments of the invention.

Referring now to FIG. 3, swing cylinder 23 comprises translating sleeve 25, piston 30, spool 32, piston rods 34, 36, springs 38, and hydraulic ports 40, 42. Piston 30 is disposed within translating sleeve 25 and divides the interior of the sleeve into two hydraulic chambers 44, 46. Springs 38 urge spool 32 to the center of piston 30 such that ports 48 and 50 communicate with the center portion 52 of the spool thus effectively deactivating control of swing cylinder 23.

Figure 4:
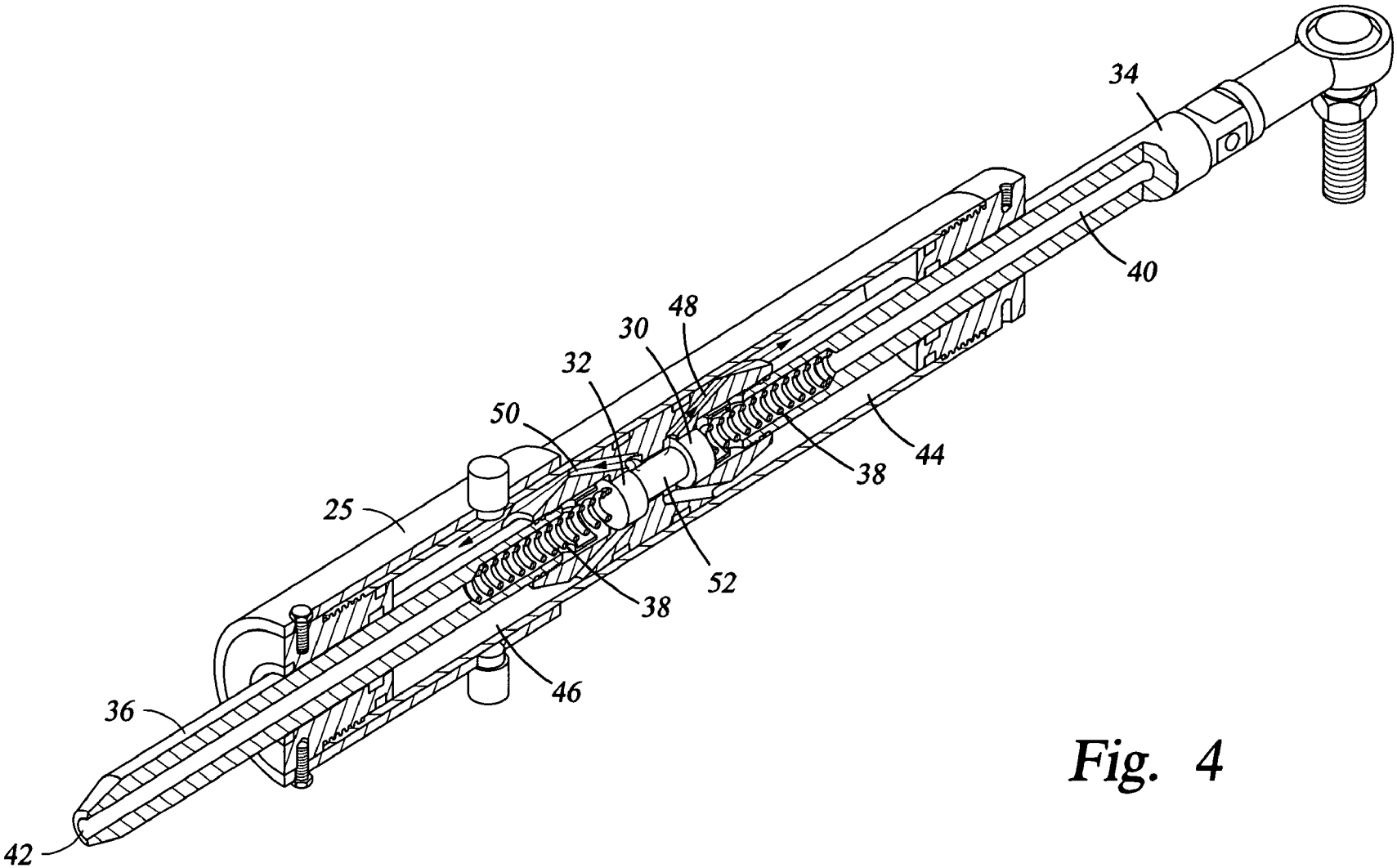
FIG. 4 is a partial cross-sectional view of the cylinder of FIG. 3 shown in a free movement position.

Referring now to FIG. 4, swing cylinder 23 is shown in a free movement position where sleeve 25 can move laterally relative to piston rods 34, 36. In the absence of hydraulic pressure from ports 40 or 42, springs 38 will urge spool 32 to a centered position where ports 48 and 50 are placed in fluid communication with each other. Thus, as sleeve 25 is moved, hydraulic fluid from chamber 44 will move, through ports 48 and 50, across piston 30 into chamber 46. The movement of sleeve 25 is only restricted by the movement of fluid through ports 48 and 50 and therefore little external force is required to move the sleeve, creating a substantially free movement position.

Figure 5:
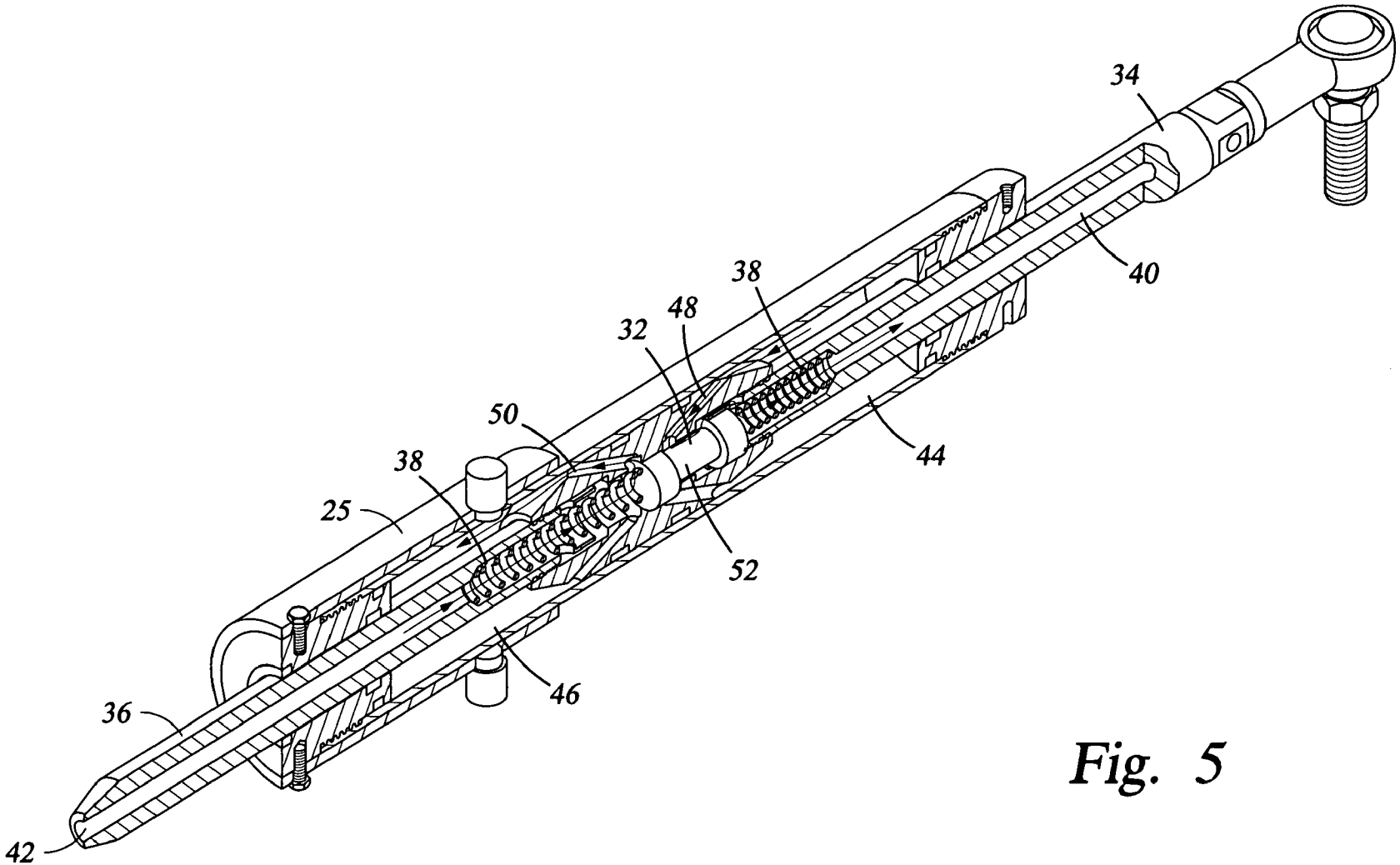
FIG. 5 is a partial cross-sectional view of the cylinder of FIG. 3 shown moving in one direction.

Referring now to FIG. 5, swing cylinder 23 is shown in an activated position where hydraulic pressure is applied to port 42. The hydraulic pressure pushes spool 32 to one side of piston 30 and substantially isolates port 50 from port 48. The hydraulic fluid flowing through port 42 moves through port 50 and into chamber 46. The fluid moving into chamber 46 will push sleeve 45 in a direction expanding the volume of chamber 46. Fluid from chamber 44 will flow through port 48 and into port 40, where it can be returned to a fluid supply system. To move sleeve 45 in the opposite direction, the flow of hydraulic fluid is reversed and enters cylinder 23 through port 40.

Thus, referring back to FIGS. 1 and 2, spooler assembly 20 comprises a spooler arm 22 operable to guide a flexible member 14 onto a drum 12 rotating about a drum axis. Swing actuator 23 moves spooler arm 22 in a swing direction 18 that is parallel to the drum axis. Swing actuator 23 operates in a swing mode wherein flexible member 14 is allowed free movement in swing direction 18 and a second mode wherein swing actuator 23 controls the movement of flexible member 14 in swing direction 18. Spooler assembly 20 may also comprise a lift actuator 26 that moves spooler arm 22 in a lift direction that is perpendicular to the drum axis. Spooler assembly 20 may also comprises pivot member 21 that is connected to lift actuator 26, which rotates the pivot member about a pivot axis that is parallel to the drum axis. Spooler arm 22 may be moveably connected to pivot member 21 such that swing actuator 23 is operable to rotate the spooler arm about a swing axis that is perpendicular to the drum axis. Rotation about the swing axis provides movement of spooler arm 22 in swing direction 18.

In certain embodiments, swing actuator 23 comprises a translating sleeve 25 connected to spooler arm 22. A piston 30 is disposed within translating sleeve 25 and forms first 44 and second 46 hydraulic chambers within the translating sleeve. A spool 32 is disposed within piston 30 and has a centered position that allows fluid communication freely through the piston between the first and second hydraulic chambers. Shifting the spool off center blocks fluid communication through the piston, thus turning the cylinder into a normal double acting hydraulic cylinder. Hydraulic pressure applied to either hydraulic port 48, 50 moves the spool from the center position to a position that allows the user to control the position of spooler arm 22.

Figure 6:
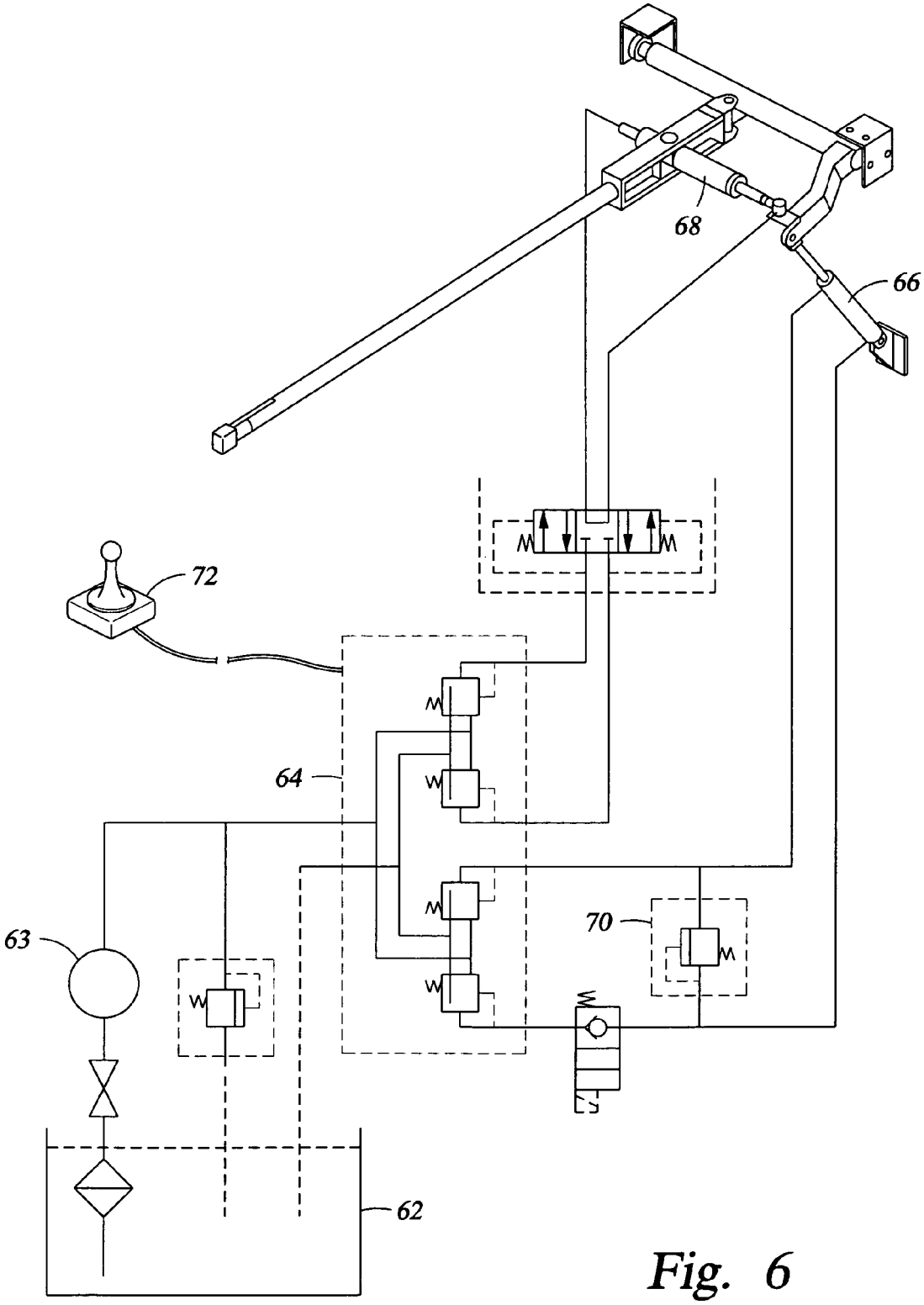
FIG. 6 is a schematic view of a hydraulic control system in accordance with embodiments of the invention.

Referring now to FIG. 6, hydraulic system 60 comprises a fluid supply 62, pump 63, a four-way control valve 64, up-down hydraulic cylinder 66, and swing cylinder 68. Relief valve 70 provides pressure relief from up-down hydraulic cylinder 66 so that the cylinder can move with the winding cable. Four-way control valve 64 may be operated by a joystick-type control 72 that can be moved in the direction that an operator wants the spooler to move.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the spooler apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. A spooler assembly comprising:

a spooler arm operable to guide a flexible member onto a drum rotating about a drum axis; and a swing actuator operable to move said spooler arm in a swing direction that is parallel to the drum axis, wherein said swing actuator operates in a first mode wherein the flexible member is allowed to freely move in the swing direction and a second mode wherein said swing actuator controls the movement of the flexible member in the swing direction; wherein said swing actuator further comprises:

a translating sleeve connected to said spooler arm;

a piston disposed within said translating sleeve; and a spool disposed within said piston, wherein said spool is in a first position when said swing actuator is in the first mode and in a second position when said swing actuator is in the second mode.

2. The spooler assembly of claim 1 further comprising a lift actuator operable to move said spooler arm in a lift direction that is perpendicular to the drum axis.

3. The spooler assembly of claim 2 further comprising a pivot member connected to said lift actuator, wherein said lift actuator is operable to rotate said pivot member about a pivot axis that is parallel to the drum axis.

4. The spooler assembly of claim 3 wherein said spooler arm is moveably connected to said pivot member, wherein said swing actuator is operable to rotate said spooler arm about a swing axis that is perpendicular to the drum axis.

5. The spooler assembly of claim 2 further comprising:

a hydraulic source in fluid communication with said swing actuator and said lift actuator; and a control system operable to control the flow fluid from said hydraulic source to said swing actuator and lift actuator.

6. The spooler assembly of claim 5 wherein said control system comprises a four-way valve.

7. The spooler assembly of claim 1 wherein said swing actuator is a double acting hydraulic cylinder.

8. The spooler assembly of claim 1 wherein said swing actuator is pressure balanced in the first mode.

9. A spooler assembly comprising:

a spooler arm operable to guide a flexible member onto a drum rotating about a drum axis; and a swing actuator operable to move said spooler arm in a swing direction that is parallel to the drum axis, wherein said swing actuator operates in a first mode wherein the flexible member is allowed to freely move in the swing direction and a second mode wherein said swing actuator controls the movement of the flexible member in the swing direction, wherein said swing actuator farther comprises:

a translating sleeve connected to said spooler arm;

a piston disposed within said translating sleeve, wherein said piston forms first and second hydraulic chambers within said translating sleeve;

a spool disposed within said piston, wherein said spool has a first position that allows fluid communication between the first and second hydraulic chambers and a second position that restricts fluid communication between the first and second hydraulic chamber; and a first hydraulic port in fluid communication with said piston, wherein hydraulic pressure applied to said first hydraulic port moves said spool from the first position to the second position, wherein when said spool is in the second position, said first hydraulic port is in fluid communication with the first hydraulic chamber.

10. The spooler assembly of claim 9 further comprising a spring operable to urge said spool to the first position.

11. The spooler assembly of claim 9 further comprising a second hydraulic port in fluid communication with said piston, wherein hydraulic pressure applied to said second hydraulic port moves said spool from the first position to the second position, wherein when said spool is in the second position, said second hydraulic port is in fluid communication with the second hydraulic chamber.

12. A spooling method comprising:

activating a spooler arm so as to control the side-to-side position of a flexible member winding onto a drum; and deactivating the spooler arm so that the flexible member and the spooler arm can move freely from side-to-side.

wherein activating the spooler arm further comprises:

supplying hydraulic pressure to a first port of a swing actuator;

providing fluid communication between the first port and a spool disposed within a piston, wherein the piston is slidably disposed within a translating sleeve and forms a first and second hydraulic chamber within the translating sleeve; and shifting a spool so as to provide fluid communication between the first port and the first hydraulic chamber.

13. The spooling method of claim 12 wherein deactivating the spooler arm further comprises:

shifting the spool so as to provide fluid communication between the first and second hydraulic chamber.

* * * * *